US005688008A

United States Patent [19]

Hänsch

[11] Patent Number: 5,688,008

[45] Date of Patent: Nov. 18, 1997

[54] SUCTION DEVICE

[75] Inventor: Egon Hänsch, Wetzikon, Switzerland

[73] Assignee: Ferag AG, Hinwil, Switzerland

[21] Appl. No.: 591,041

[22] Filed: Jan. 25, 1996

[30] Foreign Application Priority Data

Mar. 31, 1995 [CH] Switzerland ..... 909/95

[51] Int. Cl.[6] ..... B65G 59/04

[52] U.S. Cl. ..... 294/64.1; 271/103; 414/797

[58] Field of Search ..... 271/95, 96, 103; 294/64.1; 414/797

[56] References Cited

U.S. PATENT DOCUMENTS

| | | | |
|---|---|---|---|
| 2,850,279 | 9/1958 | Stoothoff et al. | 271/26 |
| 3,223,442 | 12/1965 | Fawdry et al. | 294/64 |
| 4,189,137 | 2/1980 | Denney et al. | 271/103 |
| 4,763,941 | 8/1988 | Sniderman | 271/103 X |
| 5,172,922 | 12/1992 | Kowaleski et al. | 294/64.1 X |

FOREIGN PATENT DOCUMENTS

| | | | |
|---|---|---|---|
| 585 924 | 3/1994 | European Pat. Off. . | |
| 1512907 | 10/1989 | U.S.S.R. | 294/64.1 |
| 712337 | 7/1954 | United Kingdom . | |

*Primary Examiner*—David A. Bucci
*Assistant Examiner*—Janice L. Krizek
*Attorney, Agent, or Firm*—Walter C. Farley

[57] ABSTRACT

A suction device for gripping an article has a sucker (1) with a suction lip (12). The sucker is movable between inner and outer positions in the inlet end (2) of a suction line and can be moved angularly. A reset element (3) moves the sucker to its outer position. In the inner position, the sucker forms a sealing connection with the inlet end. In its outer position, leakage air flow can pass around the outside of the sucker and into the suction line. When the sucker is in its outer position and the suction lip is closed by an article to be gripped, a pre-depression of pressure less than the maximum suction is caused because of the leakage flow. As the result of that pre-depression, the sucker is moved to its inner position, causing a sealing connection between the sucker and the inlet end of the suction line. The depression is then increased, increasing the suction grip on the article.

9 Claims, 3 Drawing Sheets

Fig. 1
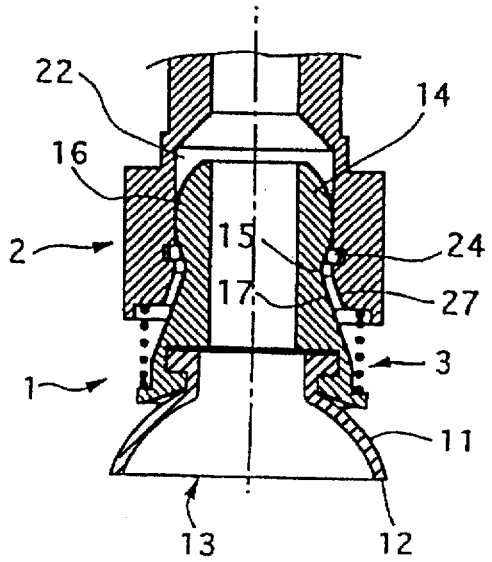
Fig. 2
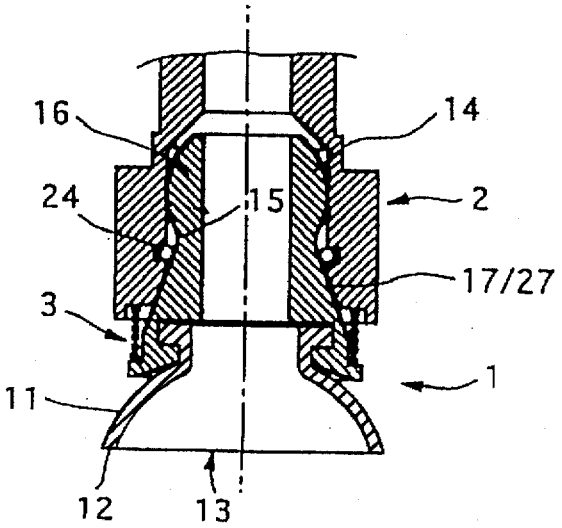
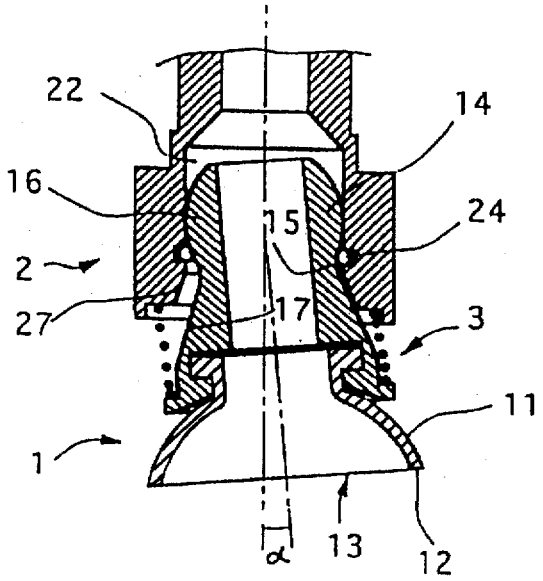
Fig. 3

SUCTION DEVICE

FIELD OF THE INVENTION

The invention concerns a suction device in which items are actively gripped and moved, especially light, flat items such as e.g. blank or printed sheets of paper or printed products consisting of several layers of paper.

BACKGROUND OF THE INVENTION

According to the state of the art suction devices are e.g. used to grip sheets of paper or items consisting of several layers of paper and to separate them from a stack. Such suction devices consist of an elastically deformable sucker which is arranged at the end of a suction line, this line end being movable relative to the stack or the sucker being movable relative to the end of the suction line for separating the gripped item from the stack. This means that the sucker is lowered onto the stack, evacuated and lifted off the stack together with the gripped uppermost item. Hereby the relative positions of the stack and the sucker in a lowered position as well as the co-ordination of the movement of the sucker, its evacuation and the strength of suction (suction force) must be very carefully adjusted to each other. This is especially the case if the items to be gripped are very lightweight and not completely tight and if it must be prevented that two or more items are gripped at the same time.

SUMMARY OF THE INVENTION

It is an object of the invention to create a suction device which, contrary to known suction devices, is absolutely reliable in different applications and whose function is less sensitively dependant on the accuracy of position adjustments and functional synchronization.

The central idea on which the suction device according to the invention is based is the following: the sucker and the end of the suction line are designed such that the sucker is evacuated by forcible actuation substantially in two steps: firstly to a pre-depression by evacuating through the suction line when the suction opening of the sucker is closed by an item to be gripped and secondly to an end-depression which is lower than the pre-depression by closing (or sealing) correspondingly provided air leaks (or incomplete seals). Furthermore, the suction device is designed such that by the effect of the pre-depression not only the provided air leaks are forcibly closed but also the sucker is forcibly displaced by a pre-travel which is independent of the movement of the end of the suction line. This means that in order to grip an uppermost item from a stack this item is gripped by the sucker being lowered onto the stack with a pre-suction force corresponding to a pre-depression and that the maximally achieved end-suction-force corresponding to the end-depression only becomes effective when the item has been slightly lifted (by the pre-travel) from the stack. As this process is forcibly actuated, it works with constant vacuum supply and without movement of the end of the suction line, i.e. without the necessity of corresponding adjustments or synchronization.

Additionally, the sucker of the inventive suction device is slewable to a restricted degree relatively to the suction line at least when in a non-evacuated condition such that it can adapt almost effortlessly to the orientation allowances between stack and sucker. This means that a high adjustment precision in this area is not necessary and the sucker need not be pressed onto the item to be gripped with force.

BRIEF DESCRIPTION OF THE DRAWINGS

The suction device according to the invention is described in detail with the help of the following Figures, wherein FIGS. 1 to 3 show diagrammatic sections of an embodiment of the inventive suction device in different operating states;

DESCRIPTION OF THE REFERRED EMBODIMENTS

Figure 4:
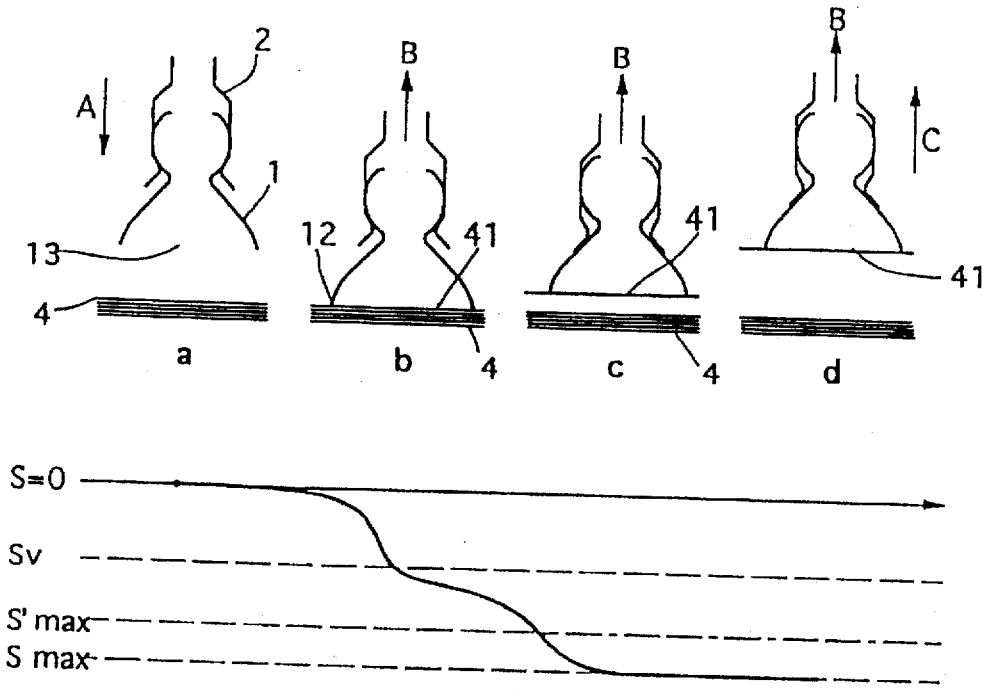
FIG. 4 shows the function of the inventive suction device during the gripping of the item.

FIGS. 1 to 3 show sections of an embodiment of the suction device according to the invention. The device consists of a sucker 1 which is arranged substantially at the end 2 of a suction line. The Figures are sections parallel to the axis of the suction line.

Sucker 1 comprises an elastically deformable skirt 11 with a suction lip 12 which lip surrounds a suction opening 13. Sucker 1 further comprises a support fitting 14 which is connected firmly to the elastic skirt 11 and substantially has the form of a tube. The end of the suction line 2 and fitting 14 of sucker 1 are matched such that sucker 1 can have two defined positions regarding the axial direction of the end 2 of the suction line, an outer position (FIGS. 1 and 3) and an inner position (FIG. 2). The inner position of sucker 1 in the end 2 of the suction line is defined by an inwardly facing stopping face 27 in the end of the suction line which face abuts and stops a corresponding outwardly facing face 17 of the sucker when the sucker is moved towards end 2 of the suction line in an axial direction. The outer position of sucker 1 in the end 2 of the suction line is defined by holding means 24, e.g. a snap ring which enters and engages a region 15 of reduced cross-section of fitting 14 such that fitting 14 is held in the end 2 of the suction line by holding means 24.

Between the end 2 of the suction line and the sucker 1 an elastic reset element 3, e.g. a spring, is arranged such that sucker 1 is forced into its outer position by this reset element 3 and held in this position.

Furthermore, fitting 14 of sucker 1 is advantageously designed such that it is slewable relative to the end 2 of the suction line to a restricted degree. This slewability is realized by a head end 16 of fitting 14 designed at least partly spherical which head end is arranged in an area 22 of the end 2 of the suction line which forms a hollow cylinder. This hollow cylinder and the spherical head end form together a kind of ball-and-socket joint. FIG. 3 shows a section of the suction device in which sucker 1 is in an outer position and is slewed relatively to the end 2 of the suction line. The ball-and-socket joint allows slewing of sucker 1 relatively to the end 2 of the suction line up to a maximum angle $\alpha$ in all directions radially with respect to the axis of end 2 of the suction line.

Stopping face 27 on end 2 of the suction line and the corresponding face 17 on fitting 14 are formed as a pair of contact faces 17, 27 providing a sealing connection between sucker 1 and end 2 of the suction line when sucker 1 is in its inner position (FIG. 2) and the two faces 17 and 27 are pressed together by a vacuum in the suction device. When the sucker is in its outer position, (FIG. 1 or 3) faces 17 and 27 are spaced from each other allowing limited air flow around the outside of the sucker. The only "seal" between end 2 of the suction line and sucker 1 in this state of the sucker is formed by the partly spherical head end 16 of fitting 14 which more or less lies on the inner wall of area 22 of the suction line. This means that in its outer position sucker 1 cannot be evacuated to the lowest possible depression (end-depression) because of the air leaking between fitting 14 and end 2 of the suction line.

The pair 17, 27 of stopping/sealing faces is advantageously formed so that they are not cylindrical relative to the axis of the end of the suction line, but rather form a frustum, thereby simultaneously being able to serve as a centering device for the sucker when it is moved from its outer position to its inner position.

In order to enable the effect of the pre-depression to move the sucker into its inner position when the suction opening 13 is closed, the suction force and the elastic readjustment element 3 must be suitably adapted to each other permitting restricted air permeability of an item to be gripped to be taken into account.

The absolute pressure of the pre-depression is determined on the one hand by the tightness of the ball-and-socket joint and on the other hand by the tightness of a gripped item. It is possible, e.g. by arranging suitable grooves in head end 16 of fitting 14 or on the inside face of cylindrical suction line area 22, to influence the pre-depression. It is also possible to make this pre-depression adjustable by means of a suitable form of the end of the suction line, whereby the pre-depression is e.g. adjustable such that the corresponding pre-depression force amounts to 10 to 50% of the sucking force which can be achieved with a tight connection between the sucker and the end of the suction line.

A variant of the suction device described in connection with FIGS. 1 to 3 shows holding means 24 which are designed to function as a seal also, such that sucker 1 is connected tightly to the end of the suction line in its outer position also. As soon as the sucker of such an embodiment is moved towards the end of the suction line, even to only a very small degree, an air leakage current occurs between the sucker and the end of the suction line, whereby an initial absolute pressure increases until the sucker reaches the inner position and the pressure then falls to the end-depression.

FIG. 4 diagrammatically shows the function of the suction device according to the invention during the process of gripping, whereby with the help of the suction device e.g. the uppermost item of a stack is gripped and removed from the stack. The Figure shows diagrammatically four consecutive stages of the suction device in section, as well as a diagram showing the corresponding progression of pressure inside the suction device or the suction force S respectively which suction force is acting on the item to be gripped or being gripped and which suction force increases with falling pressure.

Naturally the suction device according to the invention is not restricted to the application of gripping an uppermost item of a stack. In the same manner e.g. an item can be gripped which is positioned on any kind of surface or an item which is guided towards the suction device.

The four stages of the gripping process shown in FIG. 4 are the following:

a: The suction device consisting of the sucker 1 which is arranged at least axially displaceable on the end 2 of the suction line is lowered with its suction opening in front towards stack 4 (arrow A), whereby sucker 1 is in its outer position. No air is evacuated from the suction device, no suction force is acting (S=0).

b: Sucker 1 is positioned with its suction lip 12 on stack 4, i.e. its suction opening 13 is closed by stack 4 (or by the uppermost item 41 to be gripped respectively) and sucker 1 is evacuated (arrow B), whereby in sucker 1 a pre-depression is produced and a suction force S operates.

c: By the effect of the pre-depression sucker 1 has been moved into its inner position, whereby the item 41 to be gripped is slightly lifted from stack 4 and the contact faces between sucker I and end 2 of the suction line are brought into a sealing position such that an end-depression or a maximally possible suction force $S_{max}$ is obtained.

d: The suction device is moved away from stack 4 with the gripped item 41 (arrow C), whereby by the suction effect (arrow B) the sucker is held in its inner position and the gripped item 41 is gripped with suction force $S_{max}$.

The progression of pressure in the suction device or of suction force S acting on the gripped item respectively during the process of gripping therefore, as shown in the diagram in FIG. 4, has substantially two stages, whereby the minimal absolute pressure (maximal suction force) is only achieved when the item 41 to be gripped is already slightly lifted from stack 4 (stage C). This is particularly advantageous if the item to be gripped cannot seal the suction opening completely and therefore it is probable that with a high suction force a second or even several items are gripped.

Especially when gripping items with a large surface (relative to the suction opening of the sucker) the item to be gripped is slightly bent and only locally lifted from the stack by the pre-travel (movement of the sucker to its inner position). For such a movement of the item a suction force is sufficient which is considerably smaller than the force required for further lifting of the item or for totally removing it from the stack. Therefore, an increasing of suction force stage by stage is very helpful.

A dot-and-dash line in the pressure- or suction force diagram of FIG. 4 respectively shows a suction force $S'_{max}$ which concerns the gripping of an only restrictedly air tight item. This suction force $S'_{max}$ is reduced compared with the maximum suction force $S_{max}$ for a substantially air tight item to be gripped. The tightness of the item to be gripped does not have any substantial influence on the pre-depression as at a stage in which the sucker is positioned on the stack the suction opening is not closed by the individual item but by the whole stack.

Figure 5:
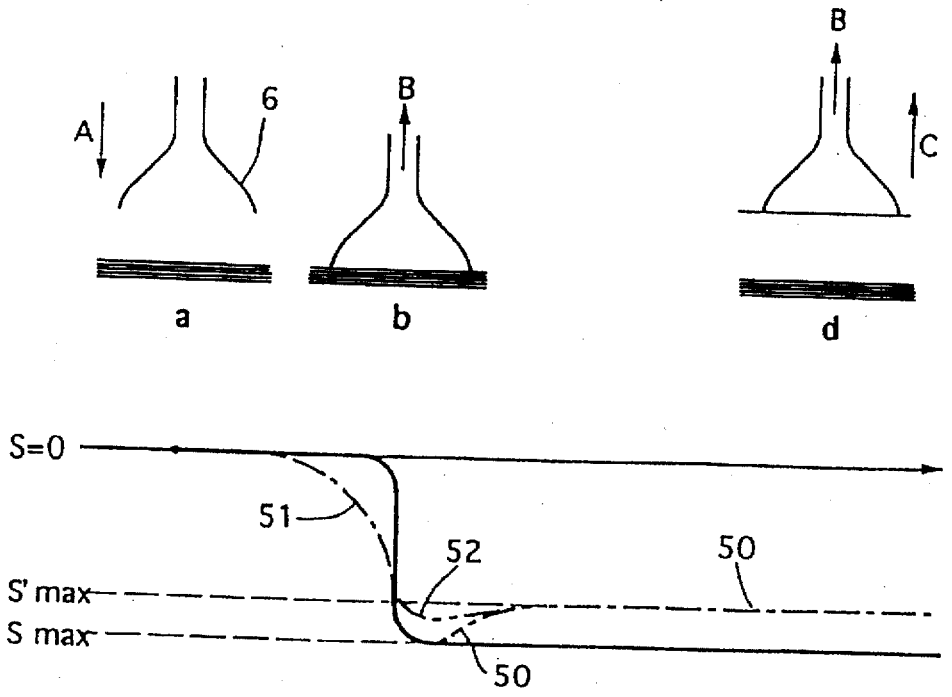
Fig. 5 PRIOR ART
FIG. 5 shows the corresponding function of a suction device according to the state of the art and FIG. 6 shows the suction device according to the invention in an example of an application: individualizing of stacked items and the delivery of these items to continuously conveyed gripping means.

FIG. 5 shows, corresponding to FIG. 4, the function of a sucker according to the state of the art during the same gripping process. This Figure serves especially to clearly show the advantages of the suction device according to the invention.

Sucker 6 according to the state of the art consists substantially of e.g. a suction lip connected rigidly to an end of a suction line which suction lip forms a suction opening. The process of gripping takes place in three stages which substantially correspond to the three stages a, b and d of FIG. 4:

a: The sucker is lowered onto the stack (arrow A).

b: The suction lip is positioned on top of the stack and the suction device is evacuated (arrow B), whereby the maximal suction force $S_{max}$ is immediately reached.

d: The suction device is lifted from the stack together with the gripped item (arrow C), whereby the gripped item is held with the maximal suction force $S_{max}$.

The pressure or suction force diagram according to FIG. 5 shows that the progression of pressure has substantially one step only, wherein the maximal suction force $S_{max}$ is reached as soon as the suction opening is closed by the stack (or the item to be gripped) and air is evacuated from the suction device. If the item to be gripped is not totally tight an air leakage current through this item is formed as soon as it is lifted from the stack whereby the suction force falls to a reduced value $S'_{max}$ (dash-and-dot line 50). If the orientation of suction lip and stack are not precisely matched, the suction lip must be brought into a sealing position under forced deformation thereby increasing the difference between the suction force ($S_{max}$) which acts on the stack and the suction force ($S'_{max}$) which acts on an only restrictedly tight item lifted off the stack. It is obvious that by the described effect, the chance that two or several items are gripped, is increased. For the same reason the chance that the item to be gripped is torn by the sucking device is increased, especially when its movements are very fast.

The mentioned disadvantages of the progression of force during a gripping process with a suction device according to the state of the art, as shown in FIG. 5, can be reduced if the suction effect starts when the sucker is not yet lowered totally onto the stack (dash-and-dot line 51) such that the item to be gripped is sucked away from the stack towards the sucker. This however results in an unguided movement of the item to be gripped which, especially with light products, leads to the danger of lateral shifting. If the sucker is never lowered right onto the stack, for a restrictedly tight item a progression of pressure is obtained (dash-and-dot lines 51, 52, 50) which comes near to the progression of pressure in the suction device according to the invention.

Such improvements of the function of the suction device according to the state of the art are however, as mentioned above, obviously only possible if the time control of the suction and the position control of the sucker are adjusted very precisely which can become very difficult for operation speeds of the suction device between 10 and 20 cycles per second. As already described above, this precision is not required when using the suction device according to the invention due to its forcible actuation during the gripping process.

Figure 6:
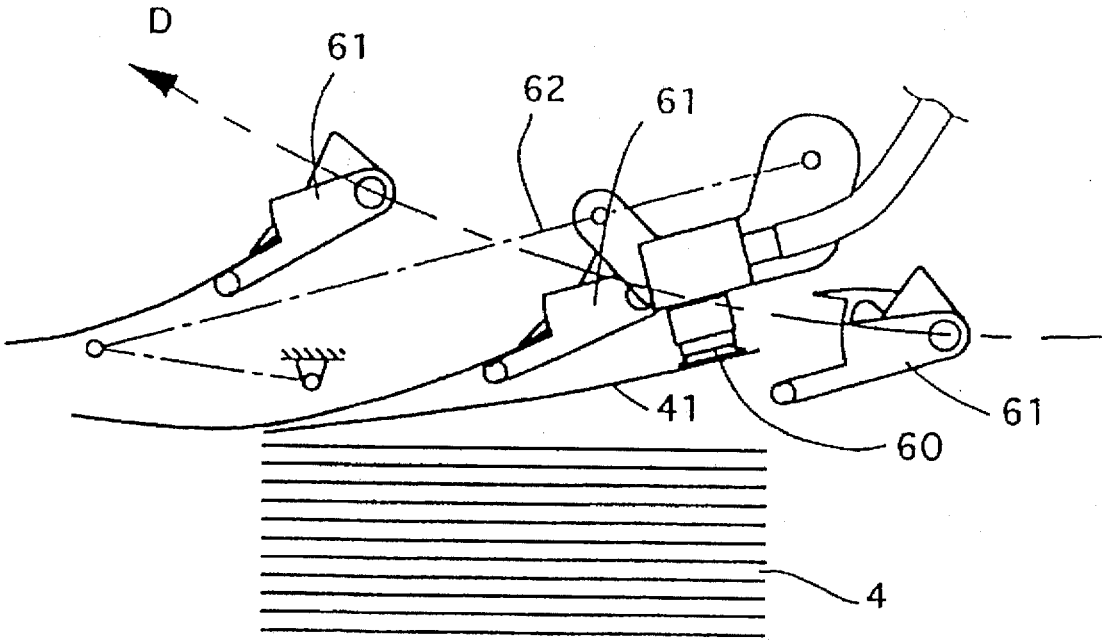

FIG. 6 diagrammatically shows the previously mentioned application of an inventive suction device 60 for cyclic gripping of the uppermost item 41 of a stack 4, its lifting from the stack into the area of continuously conveyed gripping means 61 (conveying direction D) and its being taken over by these gripping means 61. The sucker of suction device 60 is lifted by its pre-travel towards the end of the suction line during each cycle and lowered again when the item is taken over. Additionally the end of the suction line carries out a transfer movement driven e.g. by a lever system (shown diagrammatically with dash-and-dot lines) which movement does not only lift the item into a position suitable for the taking over by the gripping means but also advantageously moves it in the direction of conveying D in order to reduce the difference of speed between conveying means and item during transfer.

The function of the suction device according to FIG. 6 can be carried out with only one or with a pair of suction devices, whereby in the latter case the conveying means are advantageously conveyed between the two suction devices.

Corresponding and similar arrangements as shown in FIG. 6 are also described in the publications EP-0551601 (or GB-2260123), EP-0553455 and EP-0628505(or U.S. Pat. No. 5,542,656). In all these arrangements the described suction devices can be replaced by suction devices according to the invention thus producing the advantages described above.

Further known applications of suction devices in which the suction device according to the invention is advantageously applicable are e.g. the separation of individual items from the bottom side of a stack, as described in the publication CH-626589 (or U.S. Pat. No. 4,279,412), the separation of printed products in scaled formations in which each scale consists of several stacked items, as described in the publication EP-0403886 (or U.S. Pat. No. 5,139,386) or the opening of printed products with several pages, as described in publication CH-684085 or in the European application EP-94114275.4.

I claim:

1. A suction device comprising the combination of a suction line;

a sucker at an inlet end of said suction line, said sucker having a suction lip around a suction opening and having an outer surface, said sucker being axially movable between a first inner position in which said sucker forms a sealing relationship with said inlet end of said suction line such that air flow around said outer surface of said sucker and into said suction line is substantially prevented, and a second outer position in which said sucker is spaced from said inlet end of said suction line such that limited air flow around said outside surface of said sucker and into said suction line is permitted; and a reset element urging said sucker toward said second outer position, said sucker being movable from said second position to said first position against the urging of said reset element by reduced pressure inside said sucker and said inlet end.

2. A suction device according to claim 1 wherein said sucker comprises an elastically deformable skirt terminating at said suction lip and a support fitting rigidly connected to said elastically deformable skirt.

3. A suction device according to claim 2 wherein said support fitting includes a head and a portion of reduced cross-sectional area between said head and said skirt, wherein said inlet end of said suction line comprises a hollow cylindrical portion receiving said head, holding means for engaging said portion of reduced cross-sectional area for limiting axial movement of said sucker toward said outer position, and a stopping face engaging said skirt for limiting axial motion of said sucker toward said inner position.

4. A suction device according to claim 3 wherein said stopping face engages said skirt.

5. A suction device according to claim 3 wherein said holding means comprises a snap ring.

6. A suction device according to claim 3 wherein said head is at least partly spherical.

7. A suction device according to claim 1 wherein said sucker is angularly movable relative to said inlet end.

8. A suction device according to claim 1 wherein the amount of air flow around said sucker is adjustable.

9. A suction device according to claim 1 wherein said reset device comprises a spring.

* * * * *